US006386193B1

(12) United States Patent
Knodel

(10) Patent No.: US 6,386,193 B1
(45) Date of Patent: May 14, 2002

(54) COMBUSTION HEATER

(76) Inventor: Art Knodel, P.O. Box 154, New Sarepta, Alberta (CA), T0B 3M0

( * ) Notice: Subject to any disclaimer, the term of this patent is extended or adjusted under 35 U.S.C. 154(b) by 0 days.

(21) Appl. No.: 09/686,591

(22) Filed: Oct. 2, 2000

(30) Foreign Application Priority Data

Jul. 31, 2000 (CA) ..... 2314721

(51) Int. Cl.[7] ..... F24D 15/02
(52) U.S. Cl. ..... 126/110 B; 126/116 R; 165/179
(58) Field of Search ..... 126/110 R, 110 B, 126/110 D, 109, 104 R, 104 A, 990, 116 R; 165/179

(56) References Cited

U.S. PATENT DOCUMENTS

| | | | | |
|---|---|---|---|---|
| 685,581 A | * | 10/1901 | Dellinger | 126/116 R |
| 897,207 A | * | 8/1908 | Henzel | 126/116 R |
| 4,314,542 A | * | 2/1982 | Bratko | 126/110 R |
| D362,055 S | | 9/1995 | Knodel | D23/314 |

FOREIGN PATENT DOCUMENTS

CA 2120973 A1 * 10/1995

OTHER PUBLICATIONS

Information sheets for Sun Flare Radiant Infrared & Hot Air Heaters, Art's Welding & Machine Shop (1980) Ltd., 9 pages, dated at least as early as Sep. 5, 1995.

* cited by examiner

*Primary Examiner*—Sara Clarke
(74) *Attorney, Agent, or Firm*—Christensen O'Connor Johnson Kindness PLLC

(57) ABSTRACT

A combustion heater includes a combustion chamber having a burner input port and a heat output port. A burner is coupled to the burner input port, whereby heat is generated within the combustion chamber. A heat exchanger is provided having an inlet and an outlet. The inlet is coupled to the heat output port of the combustion chamber. The heat exchanger consists of two hollow corrugated cones secured in base to base relation with opposed apexes. This form of heat exchanger is capable of withstanding high temperatures when directly coupled with the combustion chamber and serves to make any combustion heater with which it is coupled more efficient.

3 Claims, 3 Drawing Sheets

COMBUSTION HEATER

FIELD OF THE INVENTION

The present invention relates to a combustion heater.

BACKGROUND OF THE INVENTION

The problem with many combustion heaters is that a high proportion of the heat generated in the combustion chamber is released into the atmosphere with flue gases. It is not unusual for flue gas temperatures for combustion heaters to exceed 1000 degrees fahrenheit. Attempts have been made to couple the combustion chamber of a heater with various types of heat exchangers. To date those attempts have been only partially successful, as the flue temperature remains relatively high.

SUMMARY OF THE INVENTION

What is required is a combustion heater which releases less heat to atmosphere with flue gases.

According to the present invention there is provided a combustion heater which includes a combustion chamber having a burner input port and a heat output port. A burner is coupled to the burner input port, whereby heat is generated within the combustion chamber. A heat exchanger is provided having an inlet and an outlet. The inlet is coupled to the heat output port of the combustion chamber. The heat exchanger consists of two hollow corrugated cones secured in base to base relation with opposed apexes.

The combustion heater, as described above, operates much more efficiently with a heat exchanger having the described corrugated heat exchanger configuration. The corrugations on the heat exchanger provide a large surface area over which a heat exchange may be effected. The corrugations are also able to accommodate thermal expansion, thereby permitting direct coupling to the combustion chamber.

The same factors which make the corrugated construction superior for the heat exchanger, make such corrugated construction superior for a combustion chamber. Although the combustion heater will operate with other types of combustion chamber, it is preferred that the combustion chamber consist of two hollow corrugated cones secured in base to base relation with opposed apexes.

Although beneficial results may be obtained through the use of the combustion heater, as described above, flue gas temperature may be closely controlled by selecting a secondary heat exchanger that is capable of extracting a desired proportion of the heat remaining when after the flue gas passes through the primary heat exchanger.

Although beneficial results may be obtained through the use of the combustion heater, as described above, to heat ambient air, it is preferred that the heat generated by capable of being controlled and directed for use where required. Even more beneficial results may, therefore, be obtained when the combustion chamber and heat exchanger are enclosed within a housing. The housing has an air circulation inlet and an air circulation outlet. A blower is provided to circulate air through the housing from the air circulation inlet to the air circulation outlet.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 2:
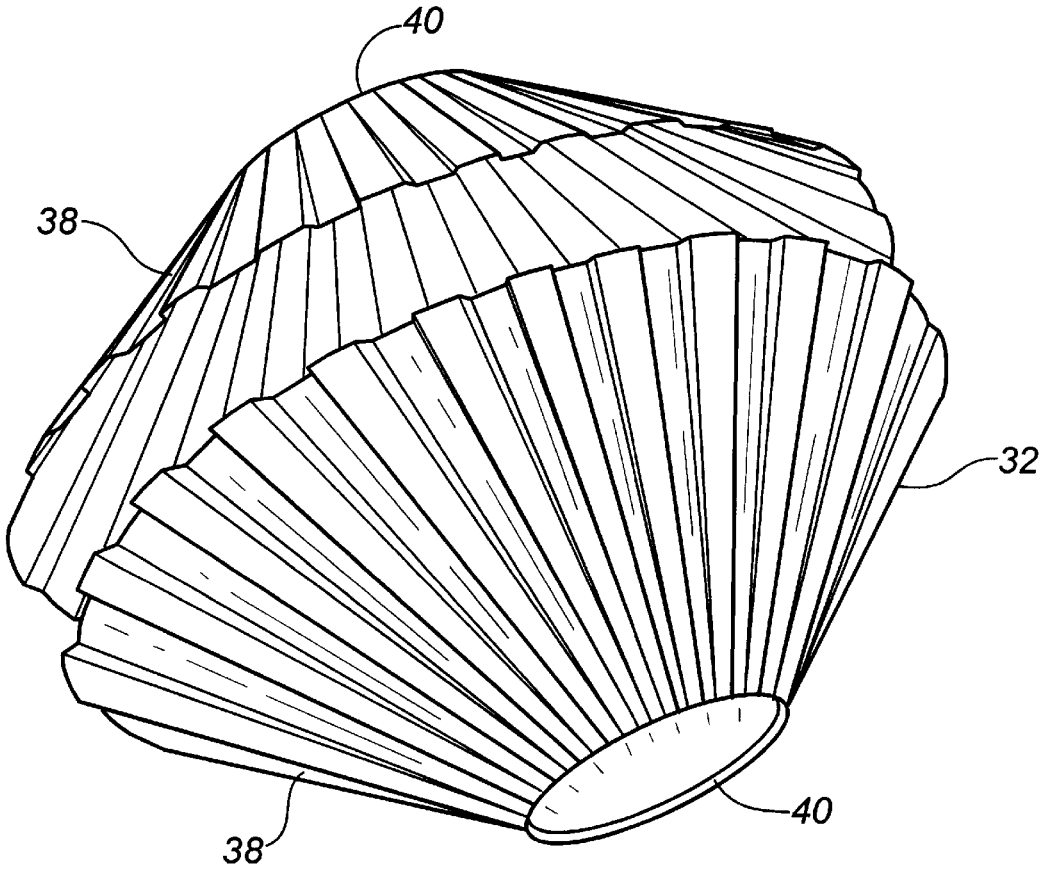
FIG. 2 is an exploded perspective view of the heat exchanger of the combustion heater illustrated in FIG. 1.
Figure 3:
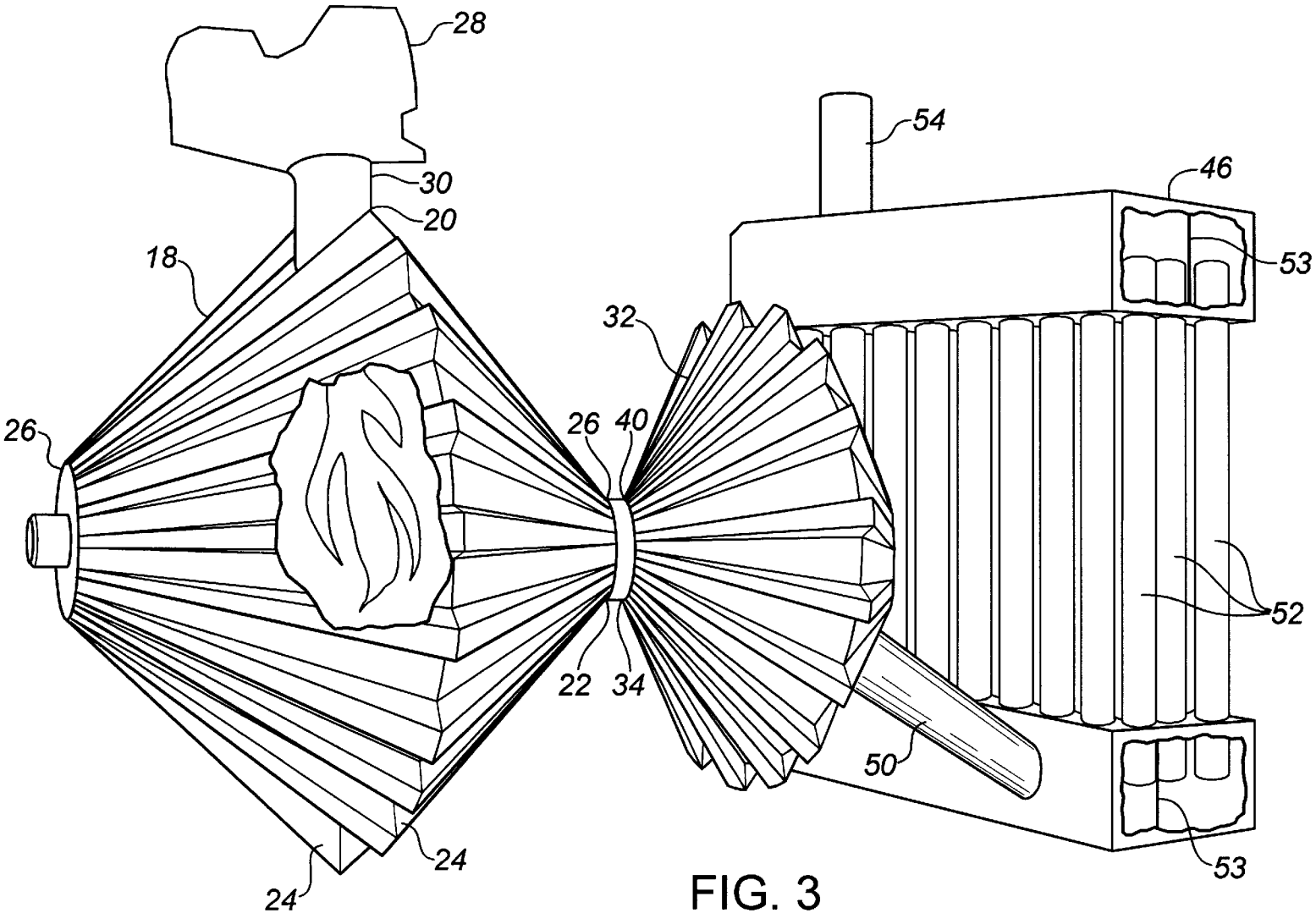
FIG. 3 is a back perspective view of internal components of the combustion heater illustrated in FIG. 1.

The preferred embodiment, a combustion heater generally identified by reference numeral 10, will now be described with reference to FIGS. 1 through 3.

Structure and Relationship of Parts

Figure 1:
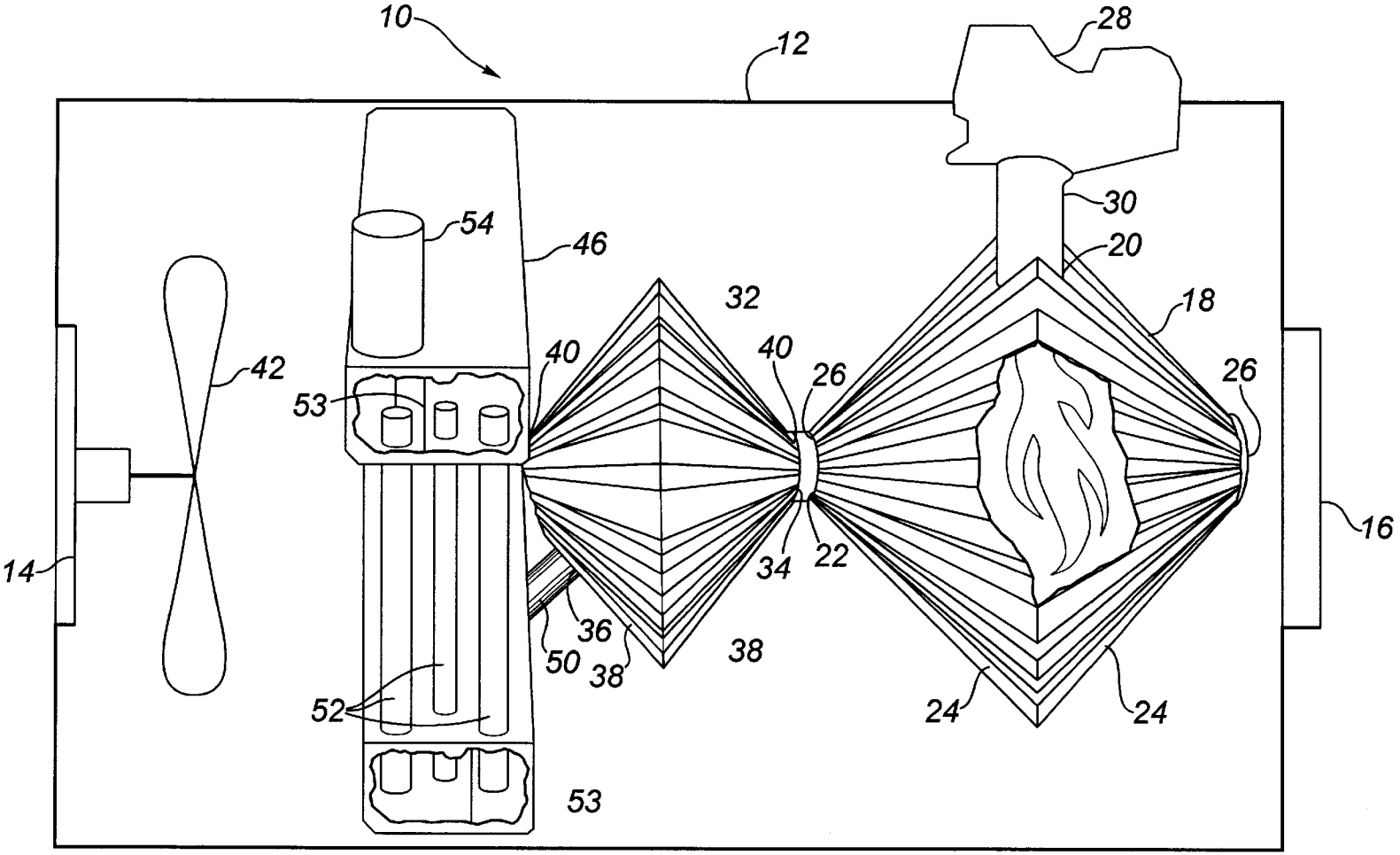
FIG. 1 is a side elevation view of a combustion heater constructed in accordance with the teachings of the present invention.

Referring to FIG. 1, there is provided a combustion heater 10 which has an insulated housing 12 with an air circulation inlet 14 and an air circulation outlet 16. Inside of housing 12 there is a combustion chamber 18 that has a burner input port 20 and a heat output port 22. Combustion chamber 18 consists of two hollow corrugated cones 24 secured in base to base relation with opposed apexes 26. A burner 28 is coupled by a conduit 30 to burner input port 20 and serves to generate heat within combustion chamber 18. Burner 28 has its own blower that provides combustion air and extends the flame down into combustion chamber 18. A heat exchanger 32 is also located within housing 12. Heat exchanger 32 has an inlet 34 and an outlet 36. Inlet 34 is coupled to heat output port 22 of combustion chamber 18. Referring to FIG. 2, heat exchanger 32 consists of two hollow corrugated cones 38 secured in base to base relation with opposed apexes 40. Referring to FIG. 1, a blower 42 circulates air through housing 12 from air circulation inlet 14 to air circulation outlet 16. In the illustrated embodiment, blower 42 is a fan. It will be appreciated, however, that other means for circulating air could be employed. A secondary heat exchanger 46 is coupled to outlet 36 of heat exchanger 32 by a flow conduit 50. In the illustrated embodiment, secondary heat exchanger 46 is a tube-style heat exchanger that has a configuration of flow tubes 52 separated by baffles 53. As hot exhaust gases pass through the flow tubes 52, air movement caused by blower fan 42 causes a heat exchange to occur. Baffles 53 are positioned to direct the air movement caused by blower fan 42 in close proximity to flow tubes 52 and slow the movement of air through secondary heat exchanger 46 down to enhance the heat exchange that occurs. The air flowing between baffles 53 and tubes 52, exits secondary heat exchanger 46 and continues its flow toward air circulation outlet 16. The hot exhaust gases flowing within tubes 52 of secondary heat exchanger 46 eventually exits tubes 52 through an exhaust outlet 54.

Operation

The use and operation of combustion heater 10 will now be described with reference to FIGS. 1 through 3. Referring to FIG. 1, when combustion heater 10 is in operation, burner 28 generates heat inside combustion chamber 18 by directing flames through burner input port 20. Corrugated cones 24 of combustion chamber 18 facilitate heating of ambient air in that corrugated cones 24 have a large surface area over which heat may be exchanged. Heated combustion gases exit combustion chamber 18 through heat output port 22 and enter heat exchanger 32 through inlet 34 of heat exchanger 32. Heat exchanger 32 also consists of two hollow corrugated cones 38 which provide a large surface area over which heat exchange may be effected. Furthermore, corrugated cones 38 are able to accommodate thermal expansion, which allows for direct coupling to combustion chamber 18. Referring to FIG. 3, heated combustion gases then flow from heat exchanger 32 through outlet 36 and into secondary heat exchanger 46. Heated combustion gases enter secondary heat exchanger 46 through flow conduit 50 and move through flow tubes 52, eventually exiting secondary heat exchanger 46 through exhaust outlet 54.

Referring to FIG. 1, air is circulated through housing 12 from air circulation inlet 14 through to air circulation outlet 16 by blower fan 42. As air is circulated through housing 12, air is heated as it passes between the flow tubes 52 and baffles 53 of secondary heat exchanger 46, over the heated corrugated surfaces of heat exchanger 32 and combustion chamber 18. The air exiting through air circulation outlet 16 of housing 12 is hot pure air. Combustion gases passing through combustion chamber 18 heat exchanger 32 and secondary heat exchanger 46 are exhausted through exhaust outlet 54.

Variations and Alternative Embodiments

It will be apparent to one skilled in the art that the combustion heater, as described above, would function without a secondary heat exchanger or with a different form of secondary heat exchanger.

Cautionary Warnings

In sizing the heat exchanger and in making the decision whether to use a secondary heat exchanger and, if so, what type of secondary heat exchanger, care must be taken not to take away too much heat. By careful sizing and selection of heat exchangers, it is possible to make the described combustion heaters with a high degree of efficiency; however, when too much heat is removed there is a danger that condensation will form in the flue. Condensation in the flue is considered undesirable, particularly during cold whether operation. It is preferred that the temperature of the flue gases be maintained at approximately 300 to 400 degrees fahrenheit to avoid condensation. This may mean running the combustion heater at between 80% and 90% efficiency. In large heating units, the combustion chamber and the heat exchanger have been made the same size. In smaller heaters, the heat exchanger has been made substantially smaller than the combustion chamber. In each case, secondary heat exchangers have been selected and used only to the extent necessary to bring the temperature of the flue gases down to the desired temperature of 300 to 400 degrees.

Care must be taken in not providing too much space for air circulation through the housing. Stagnant air within the housing is viewed as being undesirable, as is air flow through the housing that does not have to pass in close proximity to the heat exchanger and the combustion chamber. The air picks up the heat better when it is brought in close proximity to both the heat exchanger and the combustion chamber.

When connecting the hollow corrugated cones in base to base relation, care should be taken not to leave any protruding ridges which would deflect or otherwise interfere with air flow along the surface of the combustion chamber or heat exchanger.

Heat exchanger 32 takes exhaust gases directly from combustion chamber 18 and must, therefore, be capable of withstanding high temperatures. As previously stated, the construction is capable of withstanding thermal expansion. Beneficial results have been obtained using a 16 gauge 309 stainless steel. This enables a temperature rating of 2500 degree fahrenheit to be achieved.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A combustion heater, comprising:

a housing having an air circulation inlet and an air circulation outlet;

a combustion chamber disposed within the housing, the combustion chamber having a burner input port and a heat output port, the combustion chamber being two hollow corrugated cones secured in base to base relation with opposed apexes;

a burner coupled to the burner input port, whereby heat is generated within the combustion chamber;

a heat exchanger disposed within the housing, the heat exchanger having an inlet and an outlet, the inlet being coupled to the heat output port of the combustion chamber, the heat exchanger being two hollow corrugated cones secured in base to base relation with opposed apexes; and a blower, whereby air is circulated through the housing from the air circulation inlet to the air circulation outlet.

2. The combustion heater as defined in claim 1, wherein a secondary heat exchanger is coupled to the outlet of the heat exchanger.

3. The combustion heater as defined in claim 2, wherein the secondary heat exchanger has flow tubes into which hot combustion gases from the outlet of the heat exchanger pass, the air circulated by the blower being heated as it passes the flow tubes.

* * * * *

UNITED STATES PATENT AND TRADEMARK OFFICE

CERTIFICATE OF CORRECTION

PATENT NO. : 6,386,193 B1
DATED : May 14, 2002
INVENTOR(S) : A. Knodel

It is certified that error appears in the above-identified patent and that said Letters Patent is hereby corrected as shown below:

Column 3,
Lines 27-47, reads:

"Cautionary Warnings

In sizing the heat exchanger and in making the decision whether to use a secondary heat exchanger and, if so, what type of secondary heat exchanger, care must be taken not to take away too much heat. By careful sizing and selection of heat exchangers, it is possible to make the described combustion heaters with a high degree of efficiency; however, when too much heat is removed there is a danger that condensation will form in the flue. Condensation in the flue is considered undesirable, particularly during cold whether operation. It is preferred that the temperature of the flue gases be maintained at approximately 300 to 400 degrees fahrenheit to avoid condensation. This may mean running the combustion heater at between 80% and 90% efficiency. In large heating units, the combustion chamber and the heat exchanger have been made the same size. In smaller heaters, the heat exchanger has been made substantially smaller than the combustion chamber. In each case, secondary heat exchangers have been selected and used only to the extent necessary to bring the temperature of the flue gases down to the desired temperature of 300 to 400 degrees."

UNITED STATES PATENT AND TRADEMARK OFFICE

CERTIFICATE OF CORRECTION

PATENT NO. : 6,386,193 B1
DATED : May 14, 2002
INVENTOR(S) : A. Knodel

It is certified that error appears in the above-identified patent and that said Letters Patent is hereby corrected as shown below:

Column 3 cont'd,
Should read as follows:

--Cautionary Warnings:

In sizing the heat exchanger and in making the decision whether to use a secondary heat exchanger and, if so, what type of secondary heat exchanger, care must be taken not to take away too much heat. By careful sizing and selection of heat exchangers, it is possible to make the described combustion heaters with a high degree of efficiency. However, when too much heat is removed, there is a danger that condensation will form in the flue. Condensation in the flue is considered undesirable, particularly during cold weather operation. It is preferred that the temperature of the flue gases be maintained at approximately 300 to 400 degrees fahrenheit to avoid condensation. This may mean running the combustion heater at between 80% and 90% efficiency. In small heating units, the combustion chamber and the heat exchanger have been made the same size. In larger heaters, the heat exchanger has been made substantially smaller than the combustion chamber. In each case, secondary heat exchangers have been selected and used only to the extent necessary to bring the temperature of the flue gases down to the desired temperature of 300 to 400 degrees.--

Signed and Sealed this

Ninth Day of September, 2003

JAMES E. ROGAN
*Director of the United States Patent and Trademark Office*